United States Patent [19]

Spaine

[11] 4,094,544

[45] June 13, 1978

[54] PALLET PULLING DEVICE

[76] Inventor: David L. Spaine, Rte. #4, Dixon, Ill. 61021

[21] Appl. No.: 737,652

[22] Filed: Nov. 1, 1976

[51] Int. Cl.[2] ..... B66C 1/00

[52] U.S. Cl. ..... 294/82 R; 294/78 R

[58] Field of Search ..... 294/82 R, 78 R; 280/477, 480, 493, 495, 500

[56] References Cited

U.S. PATENT DOCUMENTS

| | | | |
|---|---|---|---|
| 2,531,422 | 11/1950 | Gerum | 294/82 R |
| 2,668,063 | 2/1954 | Thompson | 280/480 |
| 3,727,966 | 4/1973 | Stockwell | 294/82 R |

*Primary Examiner*—James B. Marbert

*Attorney, Agent, or Firm*—Norman H. Gerlach

[57] ABSTRACT

A pallet pulling device for sliding a palletized load from an inaccessible or remote position in a trailer or the like to a position wherein it is readily accessible to a lift truck as a preliminary to be manipulated as desired by the truck. The device is comprised of a wide face L-shaped hook member which is formed of heavy gauge plate metal stock and has at its front end a lateral or right-angle flange which is designed for cooperation with one of the transverse boards of the load-bearing pallet to which the member is applied. The rear end of the member has welded thereto one end of a short pull chain, the individual links of which may be selectively engaged by a suitable hook for pallet-pulling purposes. Said rear end of the member is rounded on an arc of the order of 180° and, by its taper or arcuate configuration, it either deflects or is deflected from foreign objects which may lie in its path when the pallet to which it is applied is pulled.

3 Claims, 6 Drawing Figures

PALLET PULLING DEVICE

The improved pallet pulling device comprising the present invention is designed for use primarily in connection with the shifting or sliding of a palletized load from a remote position deep within a trailer to a position adjacent to the open rear end of such trailer where it is readily accessible to the tines of a fork lift truck or to the jaws of a jaw-type lift truck. The invention is, however, not limited to such use and a pulling device embodying the principles of the present invention may be employed, with or without modification as required, for the short range shifting of various types of loads regardless of whether the same be palletized or not, the only requisite being that such loads be provided with suitable reaction edges or surfaces which are capable of being engaged by the pulling device. Irrespective, however, of the particular use to which the invention may be put, the essential features thereof are at all times preserved.

It is obvious that before any given palletized load can be properly engaged by the tines of a fork lift truck, the load must be completely accessible to the truck so that the fork tines may be projected beneath or into the pallet for lifting purposes. For example, if the load is stored deep within the confines of a trailer and remote from the open rear end of the latter, it is necessary to slide or otherwise move such load toward the open end of the trailer so that the operator may guide the tines of the lift truck into the confines of the pallet preparatory to lifting the load. Ordinarily, such limited shifting of the palletized load has been accomplished by the operator of the fork lift truck who is obliged to dismount from the truck and enter the trailer so that he may manually slide the load to the desired location. An ordinary chain or a cable and hook device has sometimes been used to pull the load toward the open end of the trailer but such a device is not altogether satisfactory inasmuch as the hook which is involved frequently damages the pallet to which it is applied and, furthermore, if the base of the load is coextensive with the pallet area, or nearly so, there is no room for application of the hook to any of the transverse pallet boards or members.

The present invention is designed to overcome the above noted difficulties that are attendant upon the unloading of freight-carrying trailers or other vehicles and, toward this end, the invention contemplates the provision of a novel and extremely simple pallet pulling device which is of unitary construction so that it may readily be carried by a truck driver, or by the operator of a fork lift truck as an adjunct to the lift truck, and which, when needed, may easily be applied to a pallet for pulling purposes without danger of damaging the pallet when tensional force is applied to the device. Moreover, the present device is so designed that even if the effective supporting area of the pallet is covered by the load, this fact does not preclude the effective use of the device for pallet moving or pulling purposes.

The provision of a pallet pulling device such as has briefly been outlined above constitutes the principal object of the present invention. In carrying out this object, the invention contemplates the provision of a generally flat, relatively wide hook member which is formed from flat plate metal stock and has its forward end provided with a laterally turned or right-angle pull flange the extent of which is no greater than the thickness of one of the transverse boards or planks of the pallet which is to be pulled by the device. The hook member is of elongated design and its rear end has welded thereto the foremost end link of a short length of a flexible captured chain. The chain thus "dangles," so to speak, from the rear end of the device and the individual links of such chain may be used as reaction members for the selective reception of a hook which is associated with an elongated pull chain that extends from the fork lift truck so that, when the hook member is operatively applied to the pallet, the device as a whole, an consequently the pallet to which it is applied, may be pulled rearwardly when the lift truck is backed up.

If the pallet to be moved is equipped with bottom boards, the hook member is applied to a medial region of one of the transverse bottom boards with the pull flange extending downwardly and then the pull chain or cable is hooked to one of the links of the captured chain. Thus, upon backing up of the fork lift truck, the pull chain and the captured chain, as well as the hook member, are placed under tension and the pallet is caused to slide on its supporting surface. If the pallet is not equipped with bottom boards, the hook member may be inverted so that the pull flange projects upwardly so that it may be applied to one of the transverse boards or planks on which the load is supported. Even if the effective supporting surface of the pallet is substantially completely covered by the load, such application of the hook member to the pallet is possible because the extent of the pull flange on the hook member is not greater than the thickness of the transverse board or plank to which it is applied.

A further advantageous feature of the present invention resides in the fact that the extreme rear end of the hook member, that is, the end to which one end of the chain is welded, is rounded on an arc of the order of 180° and, thus, it presents a taper or arcuate configuration which functions as a cam surface if the hook member encounters a foreign object during pulling of it. If the foreign object is not affixed to the platform or other supporting surface on which the pallet slides, such object will be pushed to one side and not be carried forward with the pallet. If it is an immovable object, as, for example, a protruding bolt or the like, the rounded rear end of the hook member will be cammed to one side and the object will thus be by-passed.

Other objects and the various advantages and characteristics of the present pallet pulling device will be readily apparent from a consideration of the following detailed description.

The invention consists in the several novel features which are hereinafter set forth and are more particularly defined by the claims at the conclusion hereof.

In the accompanying single sheet of drawings forming a part of this specification, one illustrative embodiment of the invention is shown.

Figure 1:
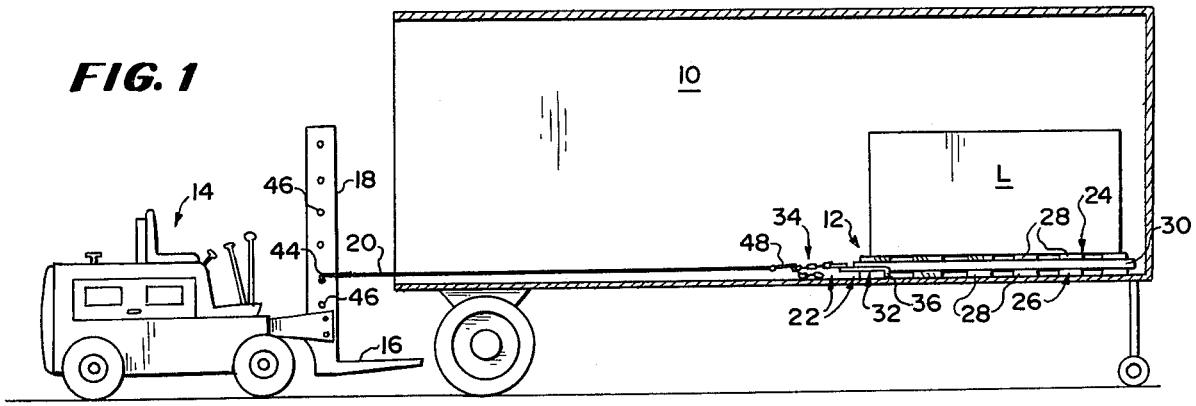
FIG. 1 is a side elevational view of a freight-carrying trailer within which there is stored a palletized load, the pallet of which is operatively connected by the pallet pulling device of the present invention to a fork lift truck, certain parts being broken away in the interests of clarity.

Referring now to the drawings in detail and in particular to FIG. 1, there is disclosed in this view a conventional open-ended trailer 10 within which there is disposed a pallet 12 which carries a load L. Disposed exteriorly of the trailer 10 and adjacent to the rear open end of the latter is a conventional fork lift truck 14 of the type which is commonly used in connection with the transporting of palletized and other loads. The front end of the trailer 10 is closed and the palletized load is shown as being disposed well within the trailer and adjacent to the forward closed end of the latter.

The lift truck 14 is provided with the usual lift tines 16 which are vertically slidable on an upstanding tine rack 18 and it is obvious that before such tines 16 can be projected beneath or into the confines of the pallet 12 for lifting purposes, the palletized load must be shifted toward the open rear end of the trailer 10 where it is accessible when the tines 16 are elevated substantially to pallet level and the fork lift truck 14 propelled forwardly in the direction of the trailer. In FIG. 1 of the drawings, the fork lift truck 14 is shown as being connected to the pallet 12 by means of a pull line in the form of a steel stranded cable 20 and a pallet pulling device 22 constituting the present invention. By backing the fork lift truck 14 away from the open end of the trailer 10, it serves to drag or slide the palletized load L to the immediate vicinity of the open end of the trailer where the pallet may readily be engaged by the tines 16 and then the pallet and its load raised and transported to a remote location wherever desired.

Figure 2:
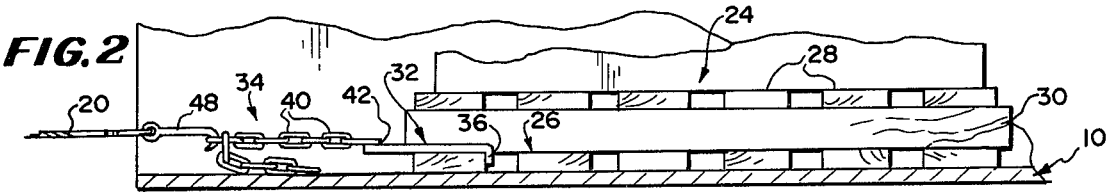
FIG. 2 is a fragmentary side elevational view of a portion of the structure shown in FIG. 1, the view being taken in the vicinity of the pallet pulling device.
Figure 3:
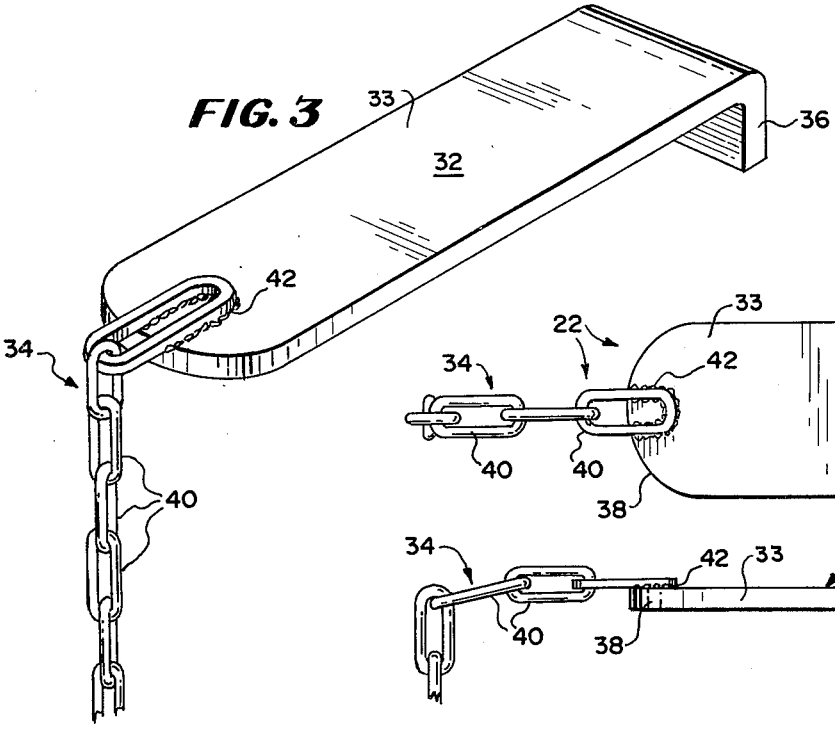
FIG. 3 is a perspective view of the pallet pulling device.
Figure 4:
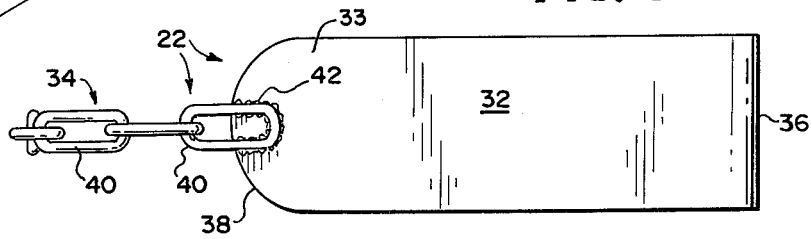
FIG. 4 is a top plan view of the pallet pulling device.

The pallet pulling device 22 by means of which the cable 20 may be connected to the pallet 12 is illustrated in detail in FIGS. 2, 3 and 4. The details of the pallet 12 appear in FIGS. 1 and 2.

The pallet 12 involves in its general organization upper and lower horizontally disposed panels 24 and 26, each panel being comprised of a plurality of spaced apart, parallel boards or planks 28 which are nailed or otherwise secured to side ribs 30 and are disposed above and below the same.

The pallet pulling device 22 of the present invention is comprised of a hook member 32 and a length of pull chain 34, the latter being fixedly secured to the former in a manner that will be set forth presently. The hook member 32 includes an elongated length or body portion 33 of heavy plate metal stock, the forward end of which is turned laterally at a right angle so as to provide what is termed herein a vertical pull flange 36. The rear end portion of the hook member 32 is rounded on a semi-circular or 180° bias as indicated at 38 (see FIG. 4). The pull chain is comprised of several individual links 40 of heavy duty chain stock, 10 such links being illustrated in the drawings although a greater or lesser number of links may be employed if desired. The outer half portion of the forwardmost link 40 of the pull chain 34 fits flatly against the upper side or surface of the rounded rear end of the hook member 32 as viewed in FIG. 3 and is welded in place as indicated at 42 with the result that the inner half portion of the forwardmost link 40 overhangs the curved or rounded rear edge 38 of the hook member 32. The pull chain is thus captured by said hook member and, in its free state, it for the most part dangles, so to speak, from the rear end of the member.

In the application of the herein described pallet pulling device to the pallet 12, the hook member 32 is inserted between the upper and lower panels 24 and 26 of the pallet and the pull flange 38 is caused to extend vertically downwardly and enter between two adjacent parallel boards or planks 28 of the lower panel 26, preferably the two rearmost planks. The forward and region of the main body portion 33 of the hook member 32 is allowed to rest upon the upper surface of the rearmost lower board or plank 28. Thereafter, a conventional hook 44 which is connected to one end of the stranded steel cable 20 is applied to one of several crossbars 46 which extend across the tine rack 18 and a similar hook 48 which is connected to the other end of the cable 20 is applied to an appropriately selected link 40 of the pull chain 34 of the device, the application being made so that a moderate degree of tension is maintained in both the pull chain 34 and the cable 20 without looseness or sagging. At this time, the operator may return to the fork lift truck 14 without danger of the hook member 32 falling from its position on the pallet 12. Upon backing up of the lift truck 14 the tension in the cable 20 and the pull chain 34 will be increased and the palletized load will be slid along the supporting surface, i.e., the bed of the trailer 10, until the load and its supporting pallet reaches the open rear end of the trailer. It is to be noted at this point that during such sliding movement of the palletized load, if the rear end of the hook member 32 encounters a foreign object which is loosely disposed on the floor or bed of the trailer 10, such object will be cammed to one side by the taper which is afforded by the rounded edge 38.

It is also to be noted that the disclosure of ten pull chain links 40 herein represents an optimum number of such links for marketing purposes, a range of from six to fifteen links might prove satisfactory. If less than six links are employed, difficulty might be encountered in selecting a link for attachment to the hook 48 of the fixed length cable 20 and if more than fifteen links are employed, the pulling device becomes unduly bulky and difficult to store when not in use.

Figure 5:
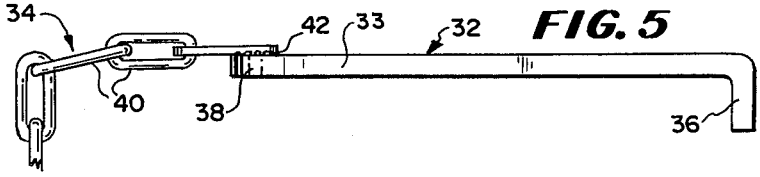
FIG. 5 is a side elevational view of the pallet pulling device.
Figure 6:
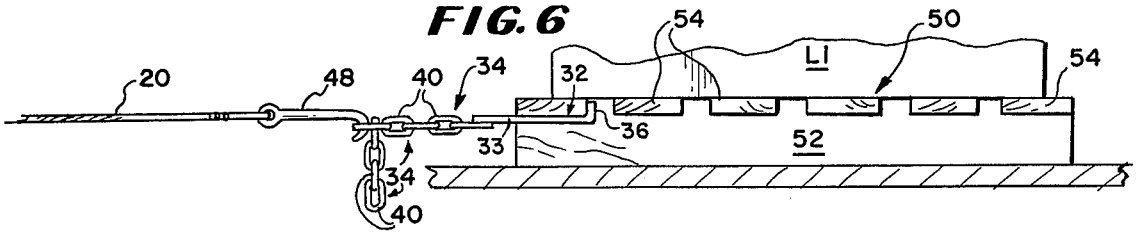
FIG. 6 is a fragmentary side elevational view similar to FIG. 2 but showing the pallet pulling device applied to a pallet which is devoice of bottom boards.

In an instance where a particular pallet is not provided with bottom boards such as the boards 28 which are associated with the lower pallet panel 26 but instead embodies only an upper or deck panel such as the panel 50 of the pallet 52 of FIG. 5, the pallet pulling device 22 may be inverted and the pull flange 36 thereof projected upwardly between adjacent planks 54. By properly selecting a link 40 of the pull chain 34 where moderate tension exists in the stranded cable 20 when the hook 48 is applied to such link, the hook member 32 will not fall from its position while the operator returns to his lift truck to back the same and thus effect pulling of the palletized load.

From the above description, it will be apparent that by the use of the present pallet pulling device, the operator of the fork lift truck may quickly and with ease apply the device to a pallet regardless of whether the latter be of the single panel or the dual panel type, and also apply a cable to the pull chain 34. At such time as the palletized load is moved to the open end of the trailer, the device 22 may be readily removed and, in either instance, i.e., during application or removal, no fastening screws or other devices are required nor does any mutilation of the pallet take place at any time. Neither is any lifting of the pallet or shifting of the load thereon necessary. Since the extent of the pull flange 36 is less than the thickness of the boards or planks 28 which are associated with the pallet 12, the deck of the trailer 10 does not interfere with the projection of the pull flange 36 between adjacent planks 28 in the case of the pallet 12. Similarly, the overlying load L does not interfere with projection of the pull flange 36 upwardly between adjacent planks 54 in the case of the pallet 52.

The invention is not to be limited to the exact arrangement of parts shown in the accompanying drawings or described in this specification as various changes in the details of construction may be resorted to without departing from the spirit or scope of the invention. Therefore, only insofar as the invention is particularly pointed out in the accompanying claims is the same to be limited.

Having thus described the invention what I claim as new and desire to secure by Letters Patent is:

1. The combination with a load-bearing pallet embodying a pair of longitudinally extending side ribs and a load-bearing panel consisting of longitudinally spaced transverse planks extending between said side ribs, of a pallet pulling device in the form of a hook member embodying an elongated horizontal body portion having its forward end turned laterally at a right angle to provide a short linearly straight hook portion, said body portion being disposed with its forward end portion abutting squarely against one of said horizontal planks and with the hook portion projecting vertically between said one plank and the next adjacent forward plank and resting squarely against the forward edge of the latter plank, the effective height of said hook portion being slightly less than the thickness of the planks, and a relatively short pull chain consisting of a series of interlocked chain links, the forward link of said pull chain being fixedly welded to the rear end of said body portion in overhanging relationship, the individual links of said pull chain being designed for cooperation with a hook which is carried by one end of a pull line, the rear edge of said body portion being rounded to provide an arc on the order of 180°, thus affording a taper designed for camming engagement with an object which may be in the pull path of the device.

2. The combination set forth in claim 1 and wherein the hook portion projects vertically downwardly between the adjacent planks with the forward end of the body portion resting squarely upon the upper face of the rearmost of the adjacent planks.

3. The combination set forth in claim 1 and wherein said hook member projects vertically upwardly between adjacent planks with the forward end of the body portion underlying and squarely abutting the underneath face of the rearmost of the adjacent planks.

* * * * *